US011148900B2

(12) United States Patent
Vulpitta et al.

(10) Patent No.: US 11,148,900 B2
(45) Date of Patent: Oct. 19, 2021

(54) ADHESIVE TAPE DISPENSER FOR FOLDED EDGE TAPE

(71) Applicants: Brian A. Vulpitta, Avon Lake, OH (US); Daniel E. Festa, Strongsville, OH (US); William F. DeWitt, Hickory, NC (US); Aaron A. Misener, Chagrin Falls, OH (US); Curtis P. Taylor, Chagrin Falls, OH (US)

(72) Inventors: Brian A. Vulpitta, Avon Lake, OH (US); Daniel E. Festa, Strongsville, OH (US); William F. DeWitt, Hickory, NC (US); Aaron A. Misener, Chagrin Falls, OH (US); Curtis P. Taylor, Chagrin Falls, OH (US)

(73) Assignee: ShurTape Technologies, LLC, Hickory, NC (US)

( * ) Notice: Subject to any disclaimer, the term of this patent is extended or adjusted under 35 U.S.C. 154(b) by 139 days.

(21) Appl. No.: 14/930,151

(22) Filed: Nov. 2, 2015

(65) Prior Publication Data

US 2016/0122151 A1 May 5, 2016

Related U.S. Application Data

(60) Provisional application No. 62/073,511, filed on Oct. 31, 2014, provisional application No. 62/076,476, filed on Nov. 6, 2014.

(51) Int. Cl.
*B65H 35/00* (2006.01)

(52) U.S. Cl.
CPC ..... *B65H 35/0033* (2013.01)

(58) Field of Classification Search
CPC ..... B65H 35/0033; B65H 45/22; B65H 35/0073; B65H 35/0046
USPC ..... 225/49, 39, 43, 91, 48
See application file for complete search history.

(56) References Cited

U.S. PATENT DOCUMENTS

| | | | | |
|---|---|---|---|---|
| 2,275,408 | A * | 3/1942 | Alliss | B65H 35/0026 225/25 |
| 2,309,093 | A * | 1/1943 | Borden | B65H 35/0046 156/465 |
| 2,992,582 | A * | 7/1961 | Castelli | B65H 35/0026 225/26 |
| 3,082,922 | A * | 3/1963 | Warp | B65H 35/008 225/19 |
| 5,171,397 | A * | 12/1992 | Arnold | B65H 35/0033 156/523 |
| 5,439,549 | A | 8/1995 | Fryc et al. | |
| 6,502,616 | B1 | 1/2003 | Row | |
| 6,524,022 | B2 * | 2/2003 | Minowa | B26F 3/02 225/1 |

(Continued)

FOREIGN PATENT DOCUMENTS

| | | |
|---|---|---|
| JP | 2001-199620 | 7/2011 |
| WO | WO 2006/032175 | 3/2006 |

*Primary Examiner* — Evan H MacFarlane
*Assistant Examiner* — Liang Dong
(74) *Attorney, Agent, or Firm* — Fay Sharpe LLP

(57) ABSTRACT

An adhesive tape dispenser and applicator which folds one or both edges of tape being applied over upon themselves is constructed with an edge folding guide having a planar surface, two inwardly converging edges and tape guides cooperating to fold the edges of the tape. A method of threading tape onto a folding tape dispenser is also described.

13 Claims, 8 Drawing Sheets

(56) References Cited

U.S. PATENT DOCUMENTS

| | | | | |
|---|---|---|---|---|
| 6,682,808 | B2 * | 1/2004 | Kobayashi | B32B 27/32 225/48 |
| 7,152,650 | B2 * | 12/2006 | Van Tyle | B65H 35/0033 156/527 |
| 7,334,620 | B2 | 2/2008 | Imazeki | |
| 7,357,285 | B2 | 4/2008 | Namekawa et al. | |
| 7,537,036 | B2 | 5/2009 | Namekawa et al. | |
| 8,393,375 | B2 | 3/2013 | Lam | |
| 8,939,375 | B2 * | 1/2015 | Huang | G06K 7/082 235/380 |
| 2001/0000096 | A1 | 4/2001 | Tolerico et al. | |
| 2004/0238109 | A1 | 12/2004 | Gonzalez | |
| 2006/0175017 | A1 * | 8/2006 | Namekawa | B65H 35/0026 156/443 |
| 2010/0084450 | A1 * | 4/2010 | Vulpitta | B65H 35/0026 225/47 |
| 2010/0282811 | A1 * | 11/2010 | Sato | B26D 1/0006 225/91 |
| 2011/0036058 | A1 * | 2/2011 | Howdeshell, II | B26D 1/0006 53/419 |
| 2011/0056615 | A1 | 3/2011 | Miyamoto et al. | |
| 2012/0097334 | A1 | 4/2012 | Lam | |

* cited by examiner

ADHESIVE TAPE DISPENSER FOR FOLDED EDGE TAPE

This application claims priority to U.S. Provisional Patent Application No. 62/073,511, filed Oct. 31, 2014, by Vulpitta et al. and entitled "ADHESIVE TAPE DISPENSER FOR FOLDED EDGE TAPE"; and, U.S. Provisional Patent Application No. 62/073,476, filed Oct. 31, 2014, by Vulpitta et al. and entitled "ADHESIVE TAPE DISPENSER FOR FOLDED EDGE TAPE"; and are incorporated herein by reference in their entirety.

FIELD OF THE DISCLOSURE

The present invention relates generally to dispensers and applicators for adhesive tape and more particularly to a convenient hand held dispenser and applicator which folds a portion of the edge of the length of tape upon itself while dispensing.

BACKGROUND OF THE DISCLOSURE

Adhesive tape is used in business settings and home settings for a variety of purposes. Adhesive tape is used in sealing boxes for shipping. Adhesive tape is used in masking surfaces in painting operations. Adhesive tape is temporarily or permanently used to repair items or bind items together for storage or other purposes. Adhesive tape for use in these situations is frequently comprised of a long substrate of paper, plastic or other film-like materials of generally uniform width and adhesive coated onto one or both sides of the substrate. Such lengths of tape are often rolled upon a core of paper, plastic or other suitable material. The users of such tape frequently buy them premounted on a dispenser or mount them on a dispenser for use in storing the tape, dispensing the tape and sometimes applying the tape to the intended workpiece.

It is sometimes advantageous to fold over one or both edges of a length of adhesive tape before applying it to the intended workpiece. In other situations, a folded edge of a tape provides a desired effect for an edge in a painting operation. In still other situations, a folded edge provides a grasping portion available when one intends to remove the tape from the temporary position after it has served its function. These and other advantages of folding the edge of the tape are known in the art.

Attempts have been made to provide tape dispensers which fold the edge of an adhesive tape length as it is dispensed from a roll. Some such dispensers are adapted for use with masking tape used in painting operations, and packaging tape. Some such dispensers are complex to manufacture, have a high part count, and are expensive. Moreover, such tape dispensers are difficult to use and difficult to thread.

SUMMARY OF THE DISCLOSURE

In accordance with the present disclosure, a tape dispenser for dispensing adhesive tape, and severing sections thereof, with one longitudinal edge or both longitudinal edges folded over upon itself is described.

The tape dispenser of the present disclosure generally comprises a first side wall with a forward end, a rearward end, a top edge and hub portion facing a second side wall having a forward end, a rearward end, a top edge and a hub portion near its rearward end; a connecting portion extending between the two side walls, and connecting the side walls in a generally parallel relationship; a cutter adjacent the forward end of the dispenser and extending between the two side walls; an edge folding guide having a first generally planar surface against which the non-adhesive side of a length of tape may engage, an inwardly facing surface generally perpendicular to the first generally planar surface with this inwardly facing surface converging toward the center line of the tape dispenser from its end near the hub its end near the cutter and a guide member adjacent the inwardly facing surface, the guide member, the inwardly facing surface, and the first generally planar surface defining a guide slot adapted to engage one of the edges of the length of tape being dispensed and fold that edge into a longitudinal fold with portions of the adhesive bearing surface confronting one another; and, a compression element between the guide slot and the cutter adapted to apply pressure to the lengths of tape bringing the confronting adhesive surface portions into contact as the tape is dispensed.

Still further in accordance with the disclosure, the dispenser is generally symmetrical about a central plane thus providing one guide slot for each edge of the tape whereby both edges of the tape may be folded and compressed in a dispensing operation.

It is an object of the present disclosure to provide a tape dispenser which will selectively fold one or both edges, or neither edge, of an adhesive tape length being dispensed as it is applied to a workpiece which is easy to use, easy to sever or cut, and easy to thread.

It is another object of the present disclosure to provide a tape dispenser which will fold one or both edges of a length of adhesive tape that increases tensile strength of the tape.

It is another object of the present disclosure to provide a tape dispenser which will fold one or both of the edges to provide reinforced strength to the tape edge, eliminating the possibility of unwanted tears or rips occurring from unintended edge nicks, damage, and film defects to the tape edge before becoming folded (i.e. storage, converting, manufacturing, or packaging process). The folded edge(s) also provides increased edge protection from edge tear damage after the tape is applied.

It is still another object of the present disclosure to provide a tape dispenser which will fold one or both edges of a length of adhesive tape wherein the folded adhesive tape improves the ease of removal in industrial bundling applications (i.e. pallet wrapping), and moving and storage applications with improved removal from boxes or similar containers.

It is yet another object of the present disclosure which will fold the edge of the adhesive tape thereby providing a reduction to adhesive contact area relative to a workpiece, without decreasing bundling strength.

It is another object of the present disclosure to provide a tape dispenser which will fold one or both edges of a length of adhesive tape whose operation is easy to understand.

It is still another object of the present disclosure to provide a tape dispenser having an appearance which is generally familiar to consumers and is therefore readily understood and used by consumers in dispensing a piece of tape.

It is still another object of the present disclosure to provide an adhesive tape dispenser which will fold the edges of adhesive tape, and cut same, as dispensed and applied which is inexpensive to manufacture.

Further objects and advantages of the disclosure will be apparent from the following detailed description of a preferred embodiment taken together with the accompanying drawings.

DETAILED DESCRIPTION

The description and drawings herein are merely illustrative of the disclosure and various modifications, changes, and alterations can be made in the structures disclosed without departing from the scope of the disclosure.

"Generally parallel" is used herein to describe surfaces, planes, and axes which are parallel to one another and also which divert from parallel slightly to accommodate molding and design. Similarly, "perpendicular" is used to include two lines or planes at right angles to one another and two lines or planes having an intersecting angle close to 90° but being slightly greater or smaller than 90° to allow for divergence to accommodate molding (draft) or otherwise accommodate manufacturing or design. "Proximal" is used to identify something closer to a given reference than something else. "Distal" is used to identify something further from a reference than something else. "Between" is used to describe a thing operatively or physically after a first element and before a second element. Thus, a second roller may be "between" a first roller and a third roller even if, physically, it is to the left of both the first roller and third roller but a length of tape engages the rollers in the order first, second, then third. Unless otherwise clear from context, "proximal" is used to describe close to the cutter end of the tape dispenser and "distal" is used to describe something remote from the cutter end of the tape dispenser.

Figure 1:
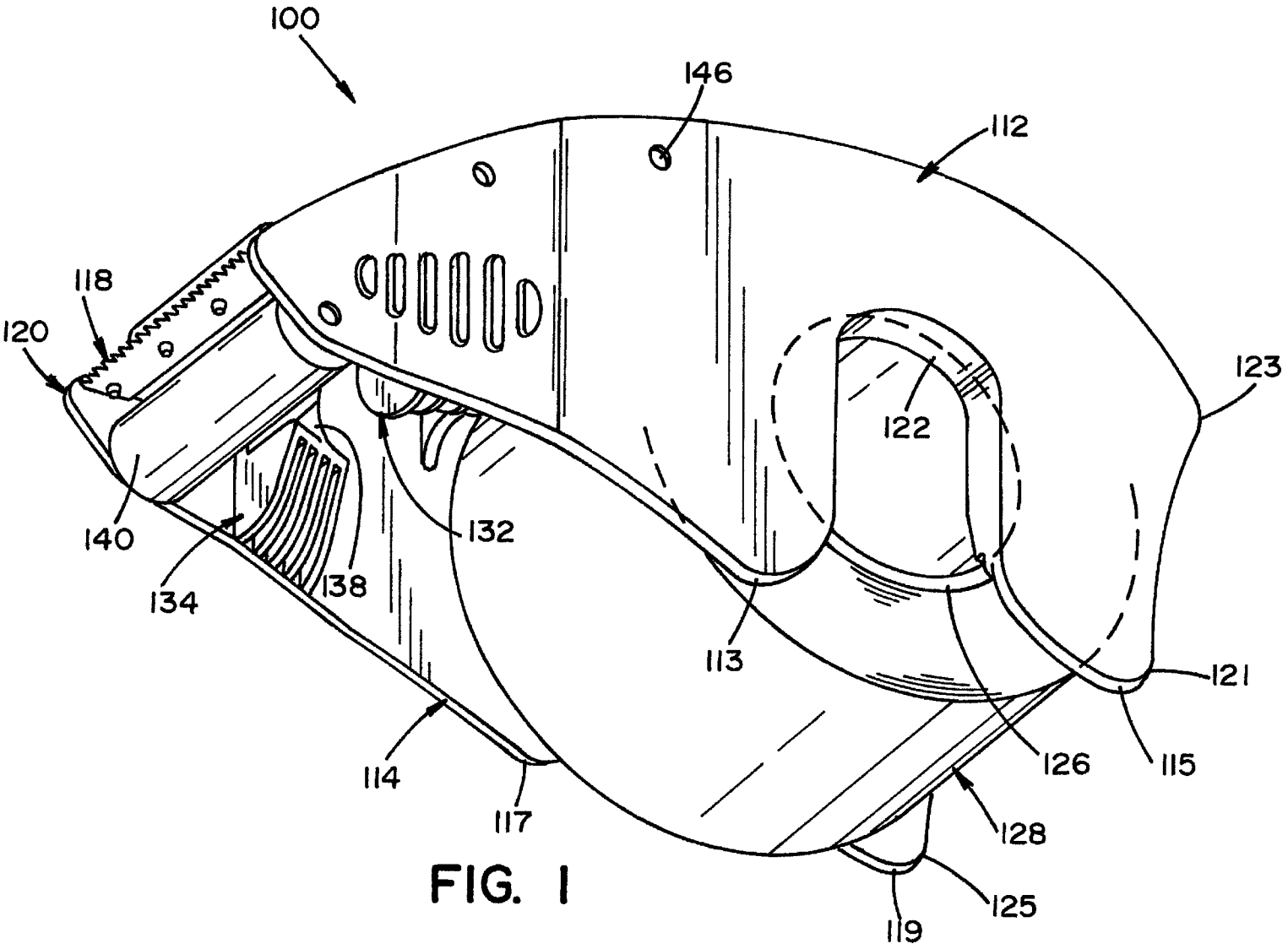
FIG. 1 is a perspective view of the tape dispenser in accordance with the disclosure looking from the bottom with a roll of tape mounted in the dispenser.

Referring now to the figures, a tape dispenser 100 has a first side wall 112, a second side wall 114, a connecting guide roller 144 (FIGS. 1 and 2) and a cutter or severing blade 118. The first side wall 112 and the second side wall 114 are generally parallel to one another and mirror images of one another.

Referring again to FIGS. 1 and 2, the first side wall 112 has a hub portion 122 near the distal end of the tape dispenser 100. The hub portion 122 includes a flange extending inwardly from the first side wall 112 (inwardly referring to towards the second side wall 114). A second hub portion 124 is in a similar position on the second side wall 114. The two hub portions 122, 124 rotatably support a core 126 of a roll of adhesive tape 128. The first side wall 112 and the second side wall 114 are mirror images of one another.

A first edge folding guide 132 is mounted to the first side wall 112 and a second edge folding guide 134 is mounted to the second side wall 114. Both edge folding guides 132, 134 are in a fixed orientation, flanked by the sidewalls 112, 114, and positioned proximal to the cutter 118. To be described in more detail hereinafter, the edge folding guides 132, 134 remain in fixed positions, and relative orientations to one another, during threading of the tape and during application of the tape to a workpiece.

The edge folding members 132, 134 are generally symmetrical about a central plane. The first edge folding guide 132 and the second edge folding guide 134 are generally mirror images of one other. The first edge folding guide 132 and the second edge folding guide 134 have progressively inwardly extending faces 136, 138 creating a progressively narrower opening 139 moving towards the cutter 118. A compression roller 140 has a cylindrical portion of a first diameter contained between the proximal end of the first side wall 112 and the proximal end of the second side wall 114. Reduced diameter portions can extend from each end of the central portion of the compression roller 140. These reduced diameter portions can extend into circular apertures in the first side wall 112 and the second side wall 114. Because the side walls 112, 114 are fabricated as by injection molding from a polymer material, the side walls can be spread apart sufficiently to allow assembly of these elements through the apertures in the side walls 112 and 114. Alternatively, a wiper integral with the edge folding guides can replace the compression roller 140. In this arrangement, the wiper can have a smooth curved downwardly facing surface (not shown) but does not rotate when tape is dispensed.

The first side wall 112 and the second side wall 114 have another pair of aligned circular holes which accept the end portions of a guide roller 144. The guide roller 144 is generally cylindrical with a crenelated or ridged outer surface to minimize the area of contact with tape. Additionally, the guide roller 144 can have extensions 146 of reduced diameter at each of its ends. The extensions 146 pass through circular openings in the first side wall 112 and the second side wall 114 rotatably fixing the guide roller 144 to the side walls 112, 114. The extensions 146 can be integrally molded with the guide roller 144 or separate elements spring loaded into recessors in the guide roller 144.

Figure 4:
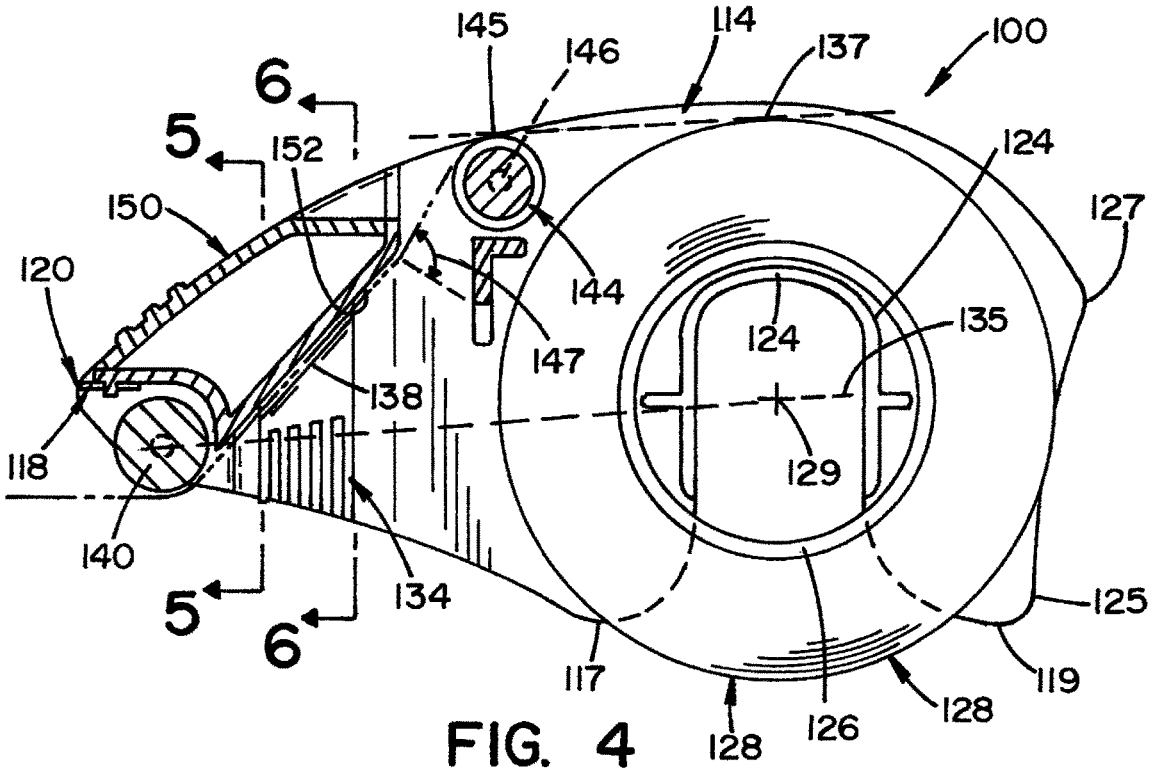
FIG. 4 is a cross sectional view of the tape dispenser taken along line 4-4 of FIG. 3.
Figure 5:
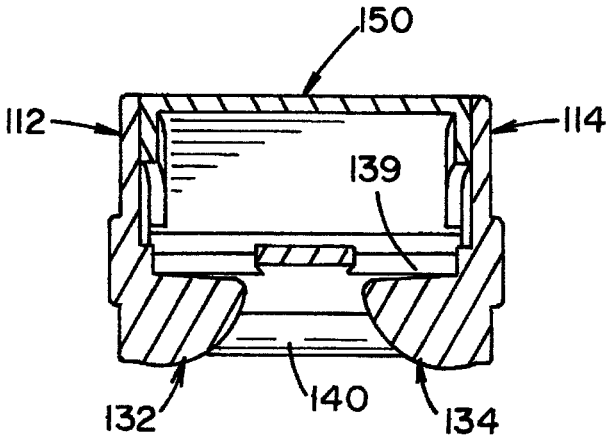
FIG. 5 is a cross sectional view of the tape dispenser taken along line 5-5 of FIG. 4.
Figure 6:
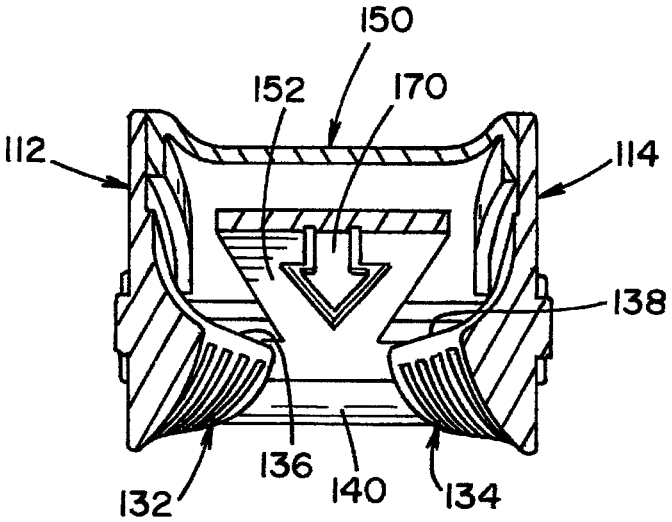
FIG. 6 is a cross sectional view of the tape dispenser taken along line 6-6 of FIG. 4.
Figure 10:
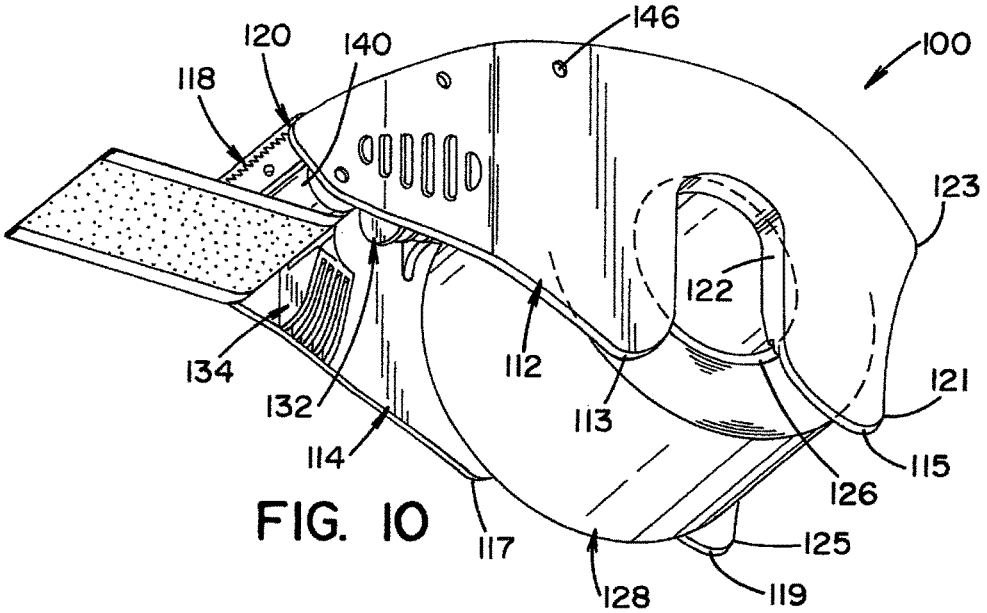
FIG. 10 is a front perspective view of the tape dispenser with the tape in the folded and ready to use position.
Figure 11:
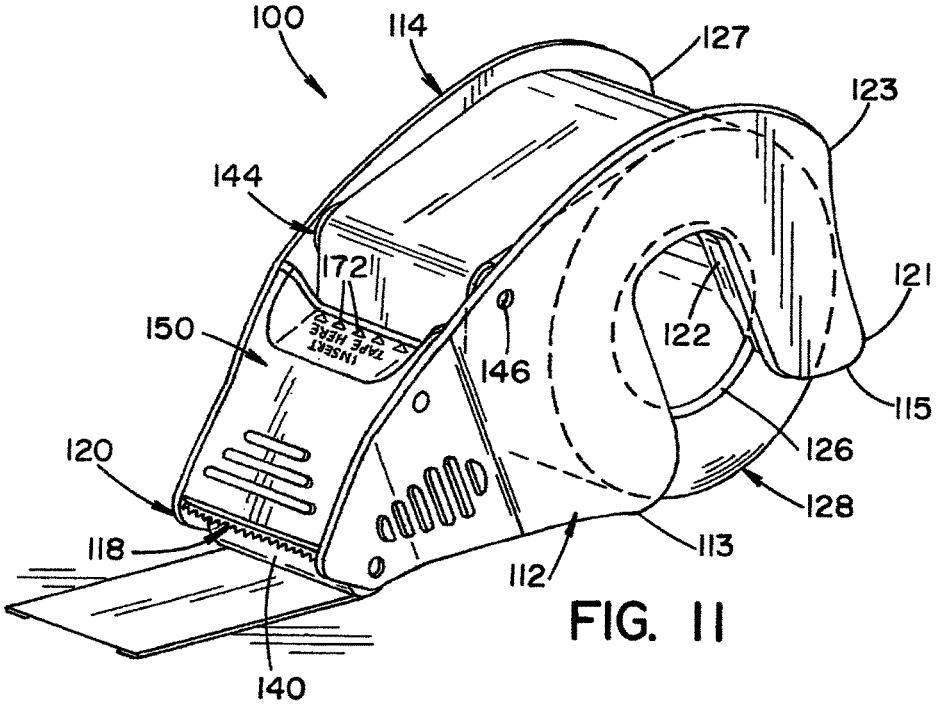
FIG. 11 shows a top forward view of the tape dispenser of FIGS. 1-10 with the tape threaded through the dispenser and being applied to a workpiece with the longitudinal edges folded.

A web element 150 extends between the first side wall 112 and the second side wall 114 generally between the compression roller 140 and the guide roller 144. There is a gap between the web element 150 and guide roller 144. One portion of the web element 150 presents a generally planar tape confronting surface 152. The tape confronting surface 152 need not be flat. It can be slightly curved or textured or otherwise, so long as it guides the tape and constrains it to interact as described below. Referring to FIGS. 4-6, the inside surfaces, that is the surfaces 136, 138 facing one another, of the first edge folding guide 132 and the second edge folding guide 134 are further away from each other proximal to the guide roller 144 when compared to the distance between these surfaces proximal to the compression roller 140. Thus, as seen in FIG. 6, the inside surface 136 of the first edge folding guide 132 and the inside surface 138 of the second edge folding guide 134 form two inwardly facing surfaces generally perpendicular to the first generally planar tape confronting surface 152 which converge toward one another. This gives the generally planer tape confronting surface 152 the shape of a trapezoid with a width at its wide end approximately the same as the width of the roll of tape to be dispensed and a relatively narrower width at its narrow end closer to the cutter 118. The first edge folding guide 132 extends inwardly from the first side wall 112 and the second edge folding guide 134 extends inwardly from the second side wall 114. The guide members 132, 134 are integrally fabricated with the side walls 112, 114. The working surfaces of the guide members 132, 134 are fashioned to work with the generally planar tape confronting surface 152 and the inside surface 136 of the first guide member 132 and the inside surface 138 of the second guide member 134 to fold over the edges of tape being dispensed. At the distal end of the generally planar tape confronting surface 152, the working surface of the guide members is spaced from the tape confronting surface and almost perpendicular to the tape confronting surface. The working surfaces 136, 138 of the guide members 132, 134 thereafter twist to gradually become more closely to parallel to the tape confronting surface 152 as the inside surfaces of the guide members 132, 134 converge. This twisting continues until the proximal end of the generally planar tape confronting surface 152 where the working surfaces of the guide members 132, 134 are almost parallel to the tape confronting surface 152 and define narrow guide slots. As a length of tape is pulled through this structure in the direction shown by the arrow 170 in FIG. 5, the edges of the tape are first forced to curl away from the tape confronting surface 152 as there is not sufficient width to accommodate the entire width of the tape. The working surfaces of the guide members 132, 134 then curl the edges of the tape so that the edges of the tape are first turned vertically and then into a confronting relationship with adjacent portions of the width of the tape. This continues to the proximal end of the tape confronting surface 152 wherein the edges of the length of the tape being dispensed are folded into proximity or contact with the next adjacent portions of the tape as seen in FIG. 10. The tape, with its edges folded over upon itself in a regular and uniform manner, is now ready for application to a workpiece and severing from the roll of tape by the cutter 118 (FIG. 11). The above described dispense operation is available for dispensing lengths of tape for the entire length of tape contained upon the roll of tape 128.

It is to be appreciated that the guide roller's placement with respect to the guide members 132, 134, in particular the proximity of the guide roller 144 to the guide members 132, 134, redirects, routes, and orientates the dispensed tape for optimum edge creasing pressure. The tape, as it is being dispensed, enters the folding or creasing zone at an angle 147 ranging from about 70° to about 110° (FIG. 4). The guide roller 144 and the guide members 132, 134 maintain a consistent feed angle 147 therebetween, even though the diameter of the roll of tape is continually decreasing throughout its consumption. The guide roller 144 uniformly orientates the tape before it enters the folding zone. Furthermore, the guide roller 144 creates a feed angle 147 preferably of about 90° for the tape's entry into the folding zone and provides for the necessary pressure to assist with forming the tightly formed edge crease(s). It is to be appreciated that an upper tangential point or plane 145 of guide roller 144 is above or higher than an upper tangential point or plane 137 of the roll of tape 128; both planes 145, 137 relative to a parallel plane 135 that intersects the center 129 of the roll of tape 128 and the center of the compression roller 140 (FIG. 4).

Figure 2:
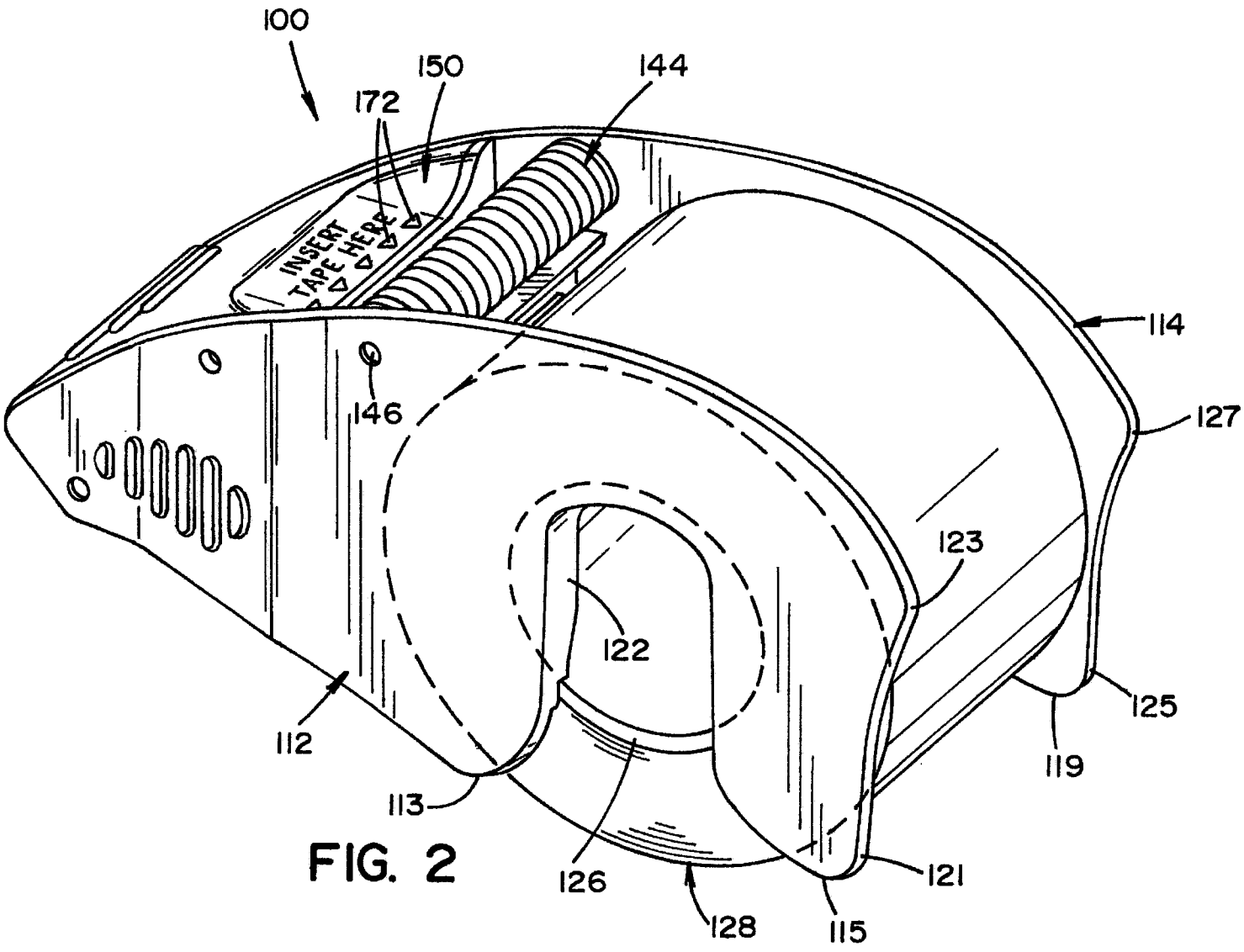
FIG. 2 is a perspective top view of the tape dispenser shown in FIG. 1.
Figure 3:
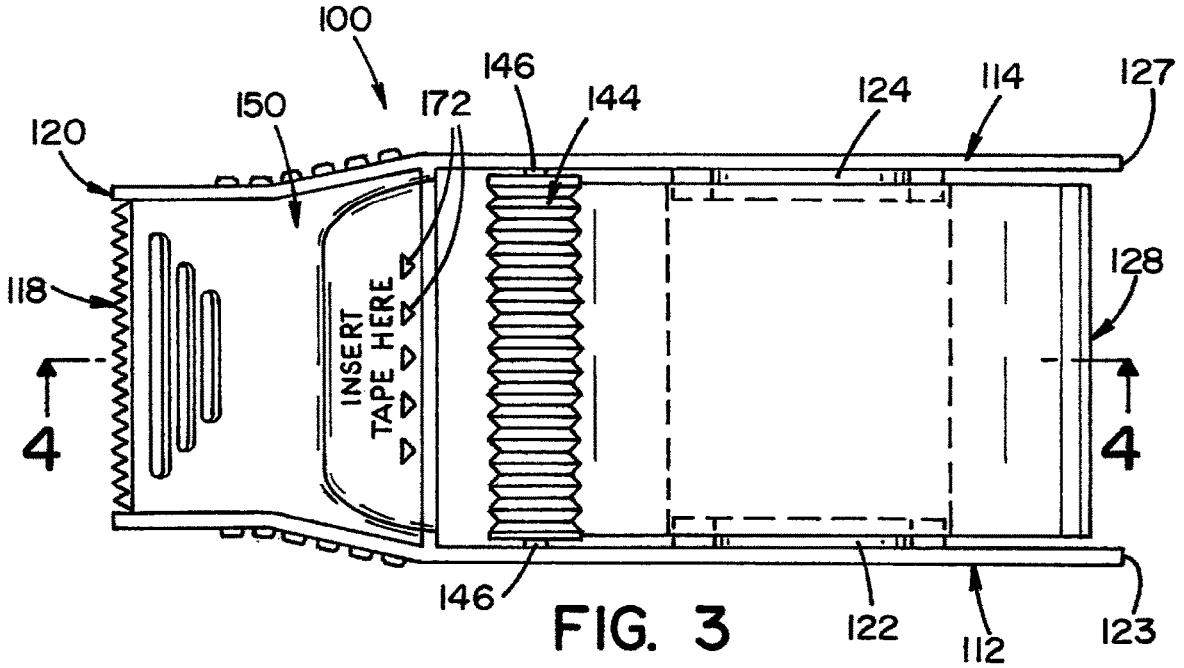
FIG. 3 is a top view of the tape dispenser.

It can be seen in FIGS. 2 and 3 that the guide roller 144 is crenelated or ridged. This reduces the surface area of the guide roller 144 about an outer circumference and allows the guide roller 144 to interact with the adhesive bearing side of the roll of tape in dispensing operation. The tape is guided as required but is not completely adhesively bound to the guide roller so as to prevent dispensing. The guide roller 144 uniformly supports the entire width of the tape, however, the crenelated surface area represents less than 50% of the guide roller's uncrenelated surface area. The crenelated surface area comes in contact with the tape. It is to be appreciated that less surface contact allows the adhesive tape to easily pass on and off the guide roller 144. The uniformity of the guide roller 144 allows for consistent orientation and presentation of the tape before entering the fold or compression area. In addition, the crenelated or ridged design of the guide roller 144 utilizes less material than a solid roller design. While the guide roller 144 is shown crenelated with circumferential ridges and grooves, other texturing of the guide roller may work as well. Thus, spiral ridges or rectangular feet and recesses would also work appropriately.

When a roll of tape is exhausted, the old core can be removed and a new roll of tape on a core placed between the first side wall 112 and the second side wall 114 with its tape core mounted on the first hub portion 122 and the second hub portion 124. The end of the tape is then fed through the opening between the guide roller 144 and the web element 150. The end of the tape is thus available to a user and can be pulled into engagement with the tape confronting surface 152, the inner surfaces 136, 138 of the guide members 132, 134 and the compression roller 140. The tape is now available for application to a workpiece in the configuration seen in FIG. 11.

When a user has applied a length of tape to a workpiece and wishes to end the application, he turns the dispenser 100 upwardly engaging the tape with the cutter 118 and cutting off the length of tape. A length of tape is thereby applied to the workpiece either to seal a container, temporarily join different workpieces, mask a workpiece for painting, or strap/wrap banding around a package. The advantages of a folded edge tape are thereby available for feather-edged painting, potentially increased tensile strength and cross directional edge strength in sealing a box or wrapping/strapping a package; as well as, easy removal of the tape after use because the non-adhesive edges are now thicker and stronger, making them readily available for grasping and removal of tape.

The edge fold(s) 130, 131 also increases the thickness and strength of the edge(s). Any edge nicks occurring in the tape film are strengthened by the folded over edge. It is to be appreciated that edge nicks in the film can occur at any time during the converting (i.e. a burr in the slitting blade), packaging, handling, and storage of tape rolls. Any edge tear or defect can cause a weakness in the tape film which can result in a cross-directional break or tear in the tape film. The folded edge(s) 130, 131 significantly strengthens any existing edge tears and breaks in the tape film. In addition, the increased thickness of the edge fold(s) also make it easier for the consumer to find and lift the edge for removal of the tape. Tape typically is very thin (i.e. 1.4 mils.-3.5 mils.), and folding the edge(s) makes it twice as thick, thereby resulting in easier location of the edge for removal.

The above-described structures are symmetrically disposed about a plane situated half way between the first side wall 112 and the second side wall 114. This provides the dispensing of tape having two folded side edges. The above-described structures can be modified by deleting the edge folding components on one side of the center line of the tape dispenser thereby folding only one edge of the tape. Thus, dispensers capable of folding one edge or both edges of a length of tape in dispensing are disclosed.

The width of the folded portion 130, 131 on each edge can be controlled by the shape of the tape confronting surface 152, the convergence of the inside surfaces 136, 138 of the guide members 132, 134 and the shape of the guide members 132, 134. Various widths of overlap can be provided. The overlaps 130, 131 can be identical on each edge of the tape or can be different sizes on one edge when compared to another.

Figure 8:
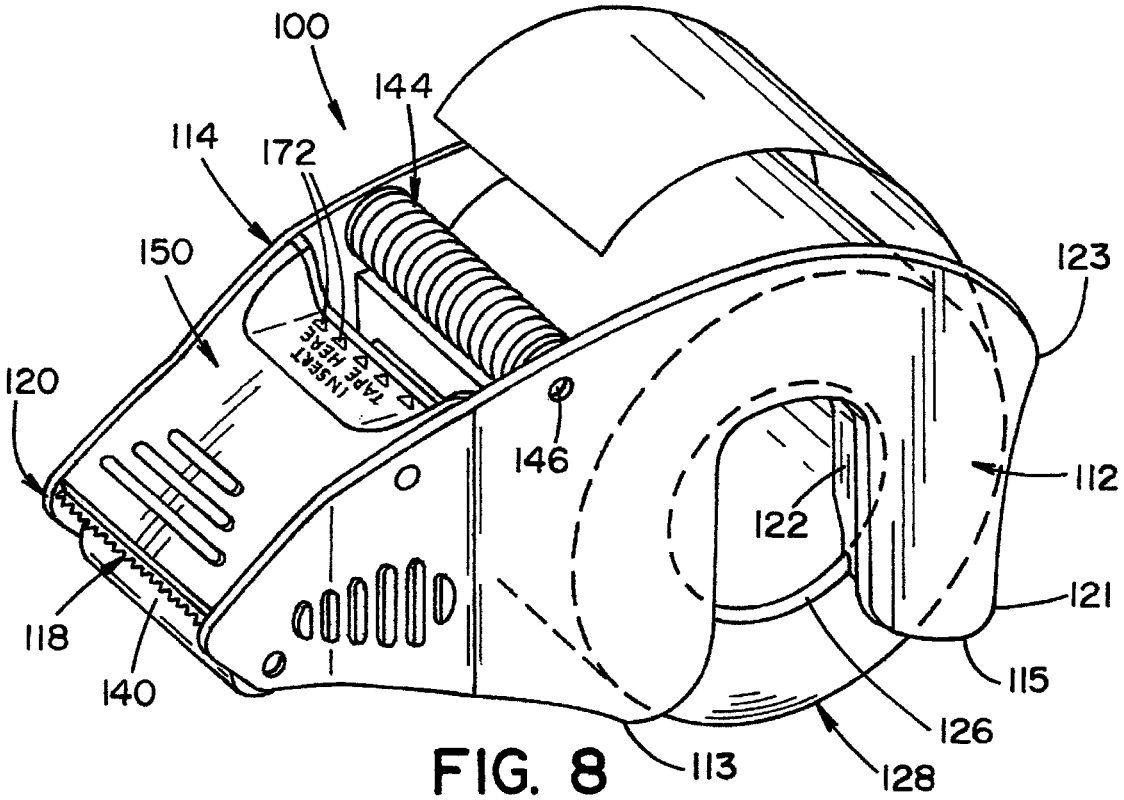
FIG. 8 is a front perspective view of the tape dispenser with the tape in the pre-threading position.

The tape dispenser 100 described has an operation similar to existing tape dispensers for use with packaging tape and the like without folded edges. Thus, once the tape is threaded, the operation of the tape dispenser 100 will be familiar to persons who have previously used hand held dispensers for non-folded edge tape. In addition, with reference to FIG. 8 molded arrows 172 can be provided on the topside of the web 150 indicating how to thread the tape. Thus, the dispenser 100 is self-explanatory in both the application of tape and the threading of tape from a new roll of tape 128 into the dispenser.

Figure 7:
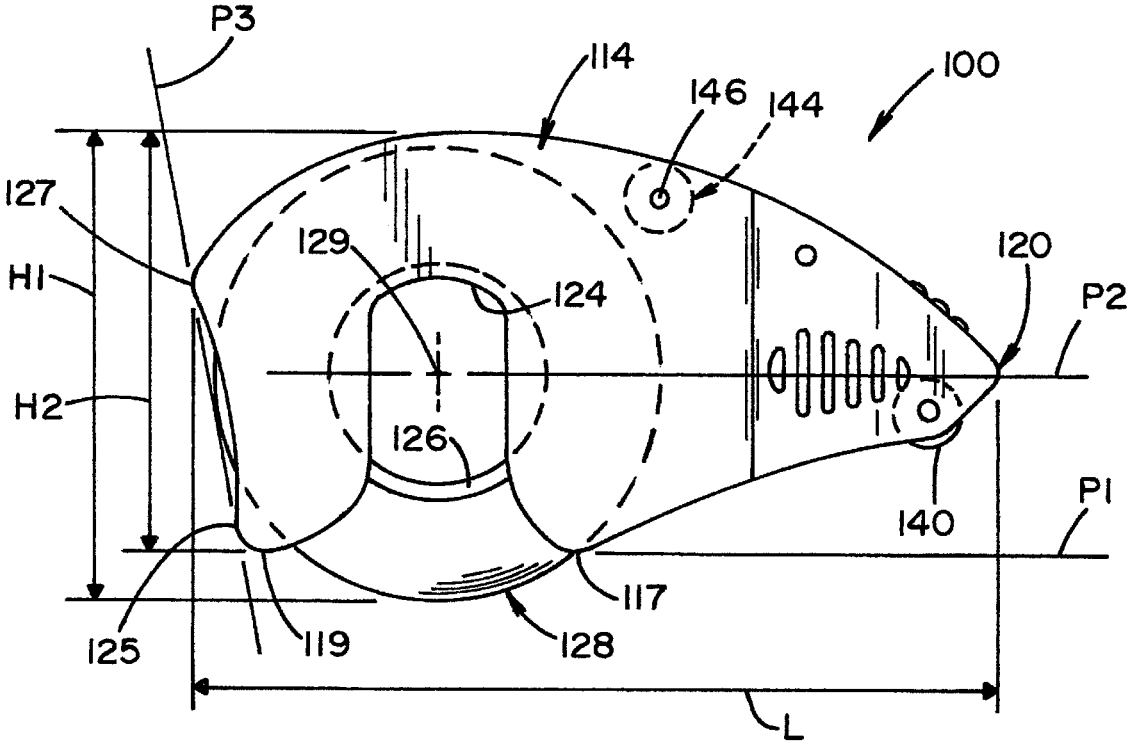
FIG. 7 is a side view of the tape dispenser.

As best shown in FIG. 7, the relative dimensions and alignment of the tape dispenser 100 provides for improved application of tape during use. Terminal ends 113, 115 of side wall 112 and terminal ends 117, 119 of side wall 114 form a plane P1. A forward extending edge 120 of the dispenser (proximal to the cutter 118) and a center 129 of the roll of tape 128, form a second plane P2. In order to facilitate ease of use and cutting of the tape when desired, P1 is generally parallel to P2. In addition, a combined height H1 of the dispenser 100 and the outermost extending portion (i.e. tangential line) of a new roll of tape 128 extending below the dispenser 100, is from about 40% to about 75% of the length L of the dispenser. In one preferred arrangement, the height H1 is from about 55% to about 60% of the length L of the dispenser 100. A height H2 of the dispenser 100 is from about 40% to about 60% of the length L of the dispenser. In one preferred arrangement, the height H2 is from about 48% to about 54% of the length L of the dispenser 100. In addition, rearward ends 121, 123 of first side wall 112 and rearward ends 125, 127 of second side wall 114 form a third plane P3. Plane P3 extends beyond the outer boundaries of a new roll of tape 128, wherein the points of contact 121, 123, 125, 127 provide support for standing the tape dispenser 100 in an upright orientation (not shown). It is to be appreciated that the width of the dispenser decreases from a maximum width at the rear of the dispenser to a minimum width at the front edge 120 of the dispenser 100 (FIG. 3). The minimum width is from about 12% to about 22% less than the maximum width. In one preferred arrangement, the minimum width is from about 15% to about 19% less than the maximum width. The change in tape dispenser width corresponds to the change in tape width from an initial non-folded width to a subsequent folded width.

Figure 9:
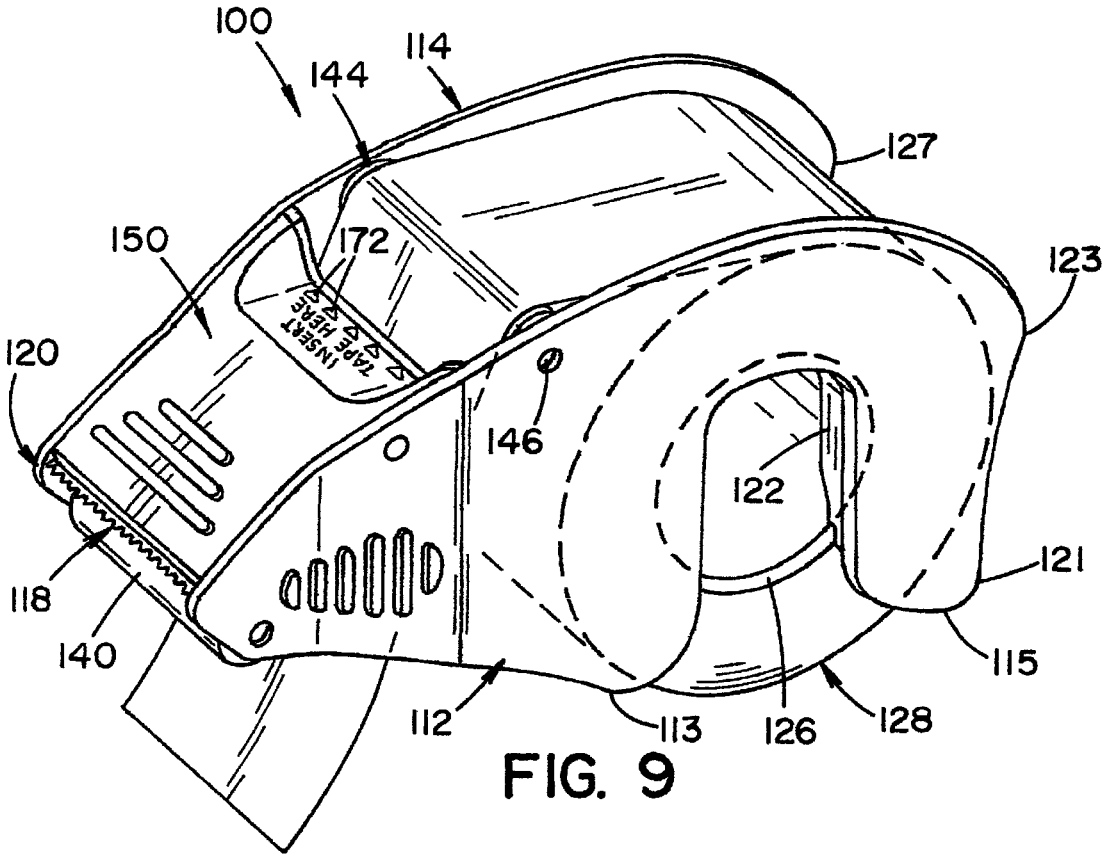
FIG. 9 is a front perspective view of the tape dispenser with the tape in the threaded position.

Referring now to FIG. 9, it is therein illustrated that the tape can be dispensed from the tape dispenser 100 while bypassing the guide members 132, 134 (i.e. selectively threading or routing the tape around the guide members 132, 134), thereby preventing the edges from being folded (i.e. non-folded edges). In this manner, the dispensed tape can selectively enter the guide members 132, 134 to fold the edges or bypass the guide members 132, 134 to maintain the tape with non-folded edges, respectively. Thus, the tape dispenser 100 provides selective methods of tape dispensing based on the user's application.

Figure 12:
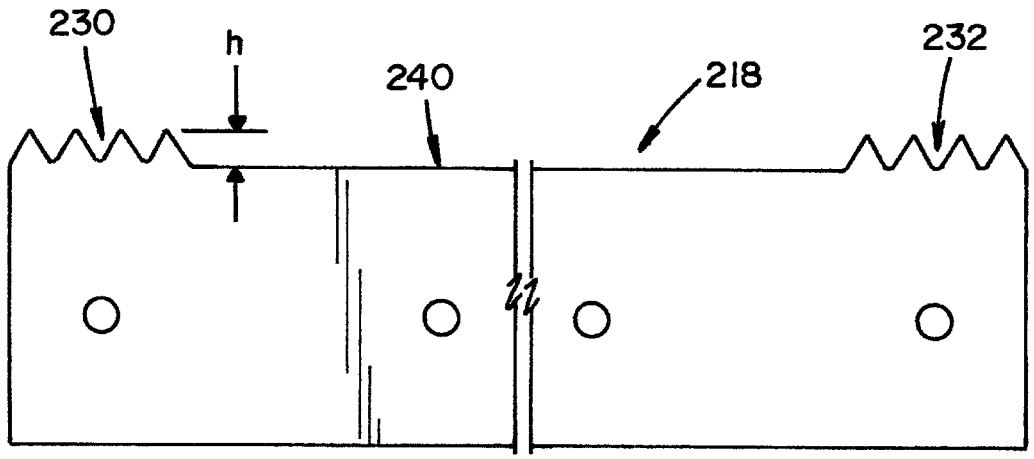
FIG. 12 displays a first embodiment of a cutter or severing blade.
Figure 13:
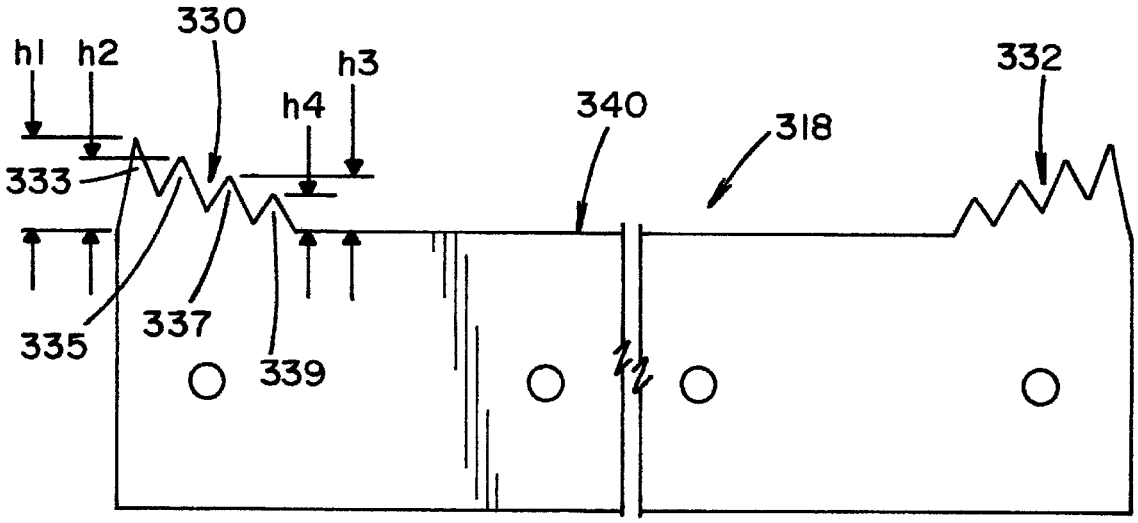
FIG. 13 displays a second embodiment of a cutter or severing blade.

A cutter or severing blade 218 can include a discontinuous series of teeth 230, 232 along the cutting edge (refer to FIGS. 12 and 13). As shown in FIG. 12, the discontinuous series of teeth 230, 232 can have a plurality of teeth with height h adjacent the outer edges of the cutter. The cutter 218 can also include an area 240 along the blade without a series of teeth. It is to be appreciated that when the tape is severed, i.e. after application to a box or carton, the middle portion of the severed terminal tape edge is spared from direct contact with the series of cutter teeth 230, 232. In this manner, the applied tape is less likely to split and separate lengthwise down a middle portion of the tape while severing and applying.

In addition, a cutter or severing blade 318 can have a discontinuous series of teeth 330, 332 including a staggered or stepped height arrangement moving from an outside edge inward (refer to FIG. 13). As shown in FIG. 13 and comprising in succession, the outer most tooth 333 can have a first height h1, the next tooth 335 can have a height h2, the next tooth 337 thereafter can have a height h3, and the next tooth 339 thereafter can have a height h4. This arrangement can be repeated on both sides of the cutter. As shown, h1 is greater than h2, h2 is greater than h3; and, h3 is greater than h4. The blade 318 can also include an area 340 along the length thereof without a series of teeth. It is to be appreciated that the staggered series of teeth 330, 332 provides a stepped saw tooth arrangement for severing the folded edge(s), while not perforating the middle section of the dispensed tape. It is to be appreciated that when the tape is severed, i.e. after application to a box or carton, the middle portion of the severed terminal tape edge is spared from direct contact with the series of cutter teeth 330, 332. In this manner, the applied tape is less likely to split and separate lengthwise down a middle portion of the tape while severing and applying.

The exemplary embodiments described above incorporate novel tape folding and novel tape threading structures into a conventional tape dispenser architecture. The novel tape edge folding and tape threading structures can be incorporated into other tape dispenser architectures without departing from the present disclosure. The disclosed structure and method, including the rotating edge folding guide, can be integrated into a pistol grip type or other type tape dispenser. Moreover, the tape edge folding and tape threading structures disclosed above will work in a tape dispenser using tape rolls with virtually any size core including those with internal diameters of 1.5 inches, 3 inches, and others. The tape edge folding and tape threading structures described above will work when integrated into a refillable type tape dispenser, an industrial pistol grip tape dispenser, and/or retail pistol grip tape dispenser. The tape edge folding and tape threading structures described above will work with any width of adhesive tape from 18 mm to 3 inches. Applicability to different types of tape is also supported in identical or slightly varying tape dispensers for use in sealing, strapping, filament strapping, binding and similar operations. The tape itself can be carton sealing tape, filament strapping tape, paper tape, duct tape, or other types of tape. The tape edge folding structure; and, the tape threading structure are reasonably integrated into any tape dispenser or tape applicator architecture or structure.

The exemplary embodiment has been described with reference to the preferred embodiment. Obviously, modifications and alterations will occur to others upon reading and understanding the preceding detailed description. It is intended that the exemplary embodiment be construed as including all such modifications and alterations insofar as they come within the scope of the appended claims or the equivalents thereof.

The invention claimed is:

1. A tape dispenser including a roll of tape and adapted to dispense lengths of said tape having a generally uniform width, an adhesive bearing surface and a non-adhesive surface from a roll of adhesive tape wound upon a core comprising:

a first side wall having a forward end, a rearward end, a top edge, and a hub portion near the rearward end, said hub portion comprising an integrally molded flange extending inwardly;

a second side wall having a forward end, a rearward end, a top edge, and a hub portion near the rearward end, said hub portion comprising an integrally molded flange extending inwardly;

said hub portions receiving the core of the roll of adhesive tape;

a connecting portion extending between the first side wall and the second side wall and connecting the first side wall and the second side wall with the first side wall and the second side wall being generally parallel to one another;

a cutter adjacent the forward end of the first side wall and the forward end of the second side wall, the cutter adapted to separate a dispensed length of tape from the roll of adhesive tape;

an edge folding guide having a first generally planar surface adapted to confront the non-adhesive surface of the lengths of adhesive tape, two inwardly facing surfaces generally perpendicular to the first generally planar surface, the two inwardly facing surfaces having ends proximal the cutter and distal the cutter and converging toward one another from the distal ends to the proximal ends, two guide members, each guide member adjacent to one of the inwardly facing surfaces, the guide members, the inwardly facing surfaces and the first generally planar surface defining guide slots adapted to engage the edges of the lengths of tape and fold the edges of the lengths of tape in longitudinal folds with portions of the adhesive bearing surface confronting one another;

a compression element between the guide slots and the cutter adapted to apply pressure to the lengths of tape and a surface to which the tape is being applied as well as bringing the confronting adhesive surface portions into contact;

wherein the cutter includes a series of teeth at each end of the cutter and a central portion of the cutter without teeth, wherein each series of teeth have varying heights, wherein a highest tooth is pointed and is at an outermost extent of the cutter and a lowest tooth is at an innermost extent of the respective series of teeth, and wherein a tooth of intermediate height is disposed between the highest tooth and the lowest tooth; and, wherein each tooth includes a longitudinal axis and the longitudinal axes of the teeth are parallel.

2. The tape dispenser of claim 1 having a length and a first height, the first height is from about 40% to about 60% of the length.

3. The tape dispenser according to claim 2, wherein the first height is from 48% to 54% of the length.

4. The tape dispenser according to claim 2, wherein the terminal ends of the first side wall and the terminal ends of the second side wall form a first plane;

the forward end and a center of a roll of tape mounted to the dispenser form a second plane; and, wherein the first plane is generally parallel to the second plane.

5. The tape dispenser according to claim 2, the tape dispenser decreases from a maximum width at the rear edge of the dispenser to a minimum width at the front edge of the dispenser; and, the minimum width is from 12% to 22% less than the maximum width.

6. The tape dispenser according to claim 5, wherein the minimum width is from 15% to 19% less than the maximum width.

7. The tape dispenser of claim 1 wherein each series of teeth has a length which corresponds with the width of the folded edge of the tape.

8. The tape dispenser of claim 1 wherein each tooth in the series is pointed.

9. A tape dispenser adapted to dispense lengths of adhesive tape having a generally uniform width, an adhesive bearing surface and a non-adhesive surface from a roll of adhesive tape wound upon a core comprising:

a first side wall having a forward end, a rearward end, a top edge, and a hub portion near the rearward end;

a second side wall having a forward end, a rearward end, a top edge, and a hub portion near the rearward end;

a connecting portion extending between the first side wall and the second side wall and connecting the first side wall and the second side wall with the first side wall and the second side wall being generally parallel to one another;

a cutter adjacent the forward end of the first side wall and the forward end of the second side wall, the cutter adapted to separate a dispensed length of tape from the roll of adhesive tape;

wherein the cutter includes a series of pointed teeth at each end of the cutter and a central portion of the cutter without teeth, each series of teeth having at least three different heights along a portion of the length of the cutter each series of pointed teeth having varying heights, wherein a highest tooth is pointed and is at an outermost extent of the cutter and a lowest tooth is at an innermost extent of the respective series of teeth, and wherein a tooth of intermediate height is disposed between the highest tooth and the lowest tooth; and, wherein each tooth includes a longitudinal axis and the longitudinal axes of the teeth are parallel.

10. The tape dispenser according to claim 9, including an edge folding guide having a first generally planar surface adapted to confront the non-adhesive surface of the lengths of adhesive tape, two inwardly facing surfaces generally perpendicular to the first generally planar surface, the two inwardly facing surfaces having ends proximal the cutter and distal the cutter and converging toward one another from the distal ends to the proximal ends, two guide members, each guide member adjacent to one of the inwardly facing surfaces, the guide members, the inwardly facing surfaces and the first generally planar surface defining guide slots adapted to engage the edges of the lengths of tape and fold the edges of the lengths of tape in longitudinal folds with portions of the adhesive bearing surface confronting one another.

11. The tape dispenser according to claim 10, further comprising a fixed and permanent selective tape dispensing path whereby the dispensed lengths of adhesive tape can selectively enter or bypass the edge folding guide, wherein the tape edges are selectively folded or non-folded upon dispensing; said bypass path being between the first sidewall and the second side wall and below the guide members.

12. The tape dispenser according to claim 9, including a compression element between the guide slots and the cutter adapted to apply pressure to the lengths of tape bringing the confronting adhesive surface portions into contact.

13. The tape dispenser of claim 9 wherein the cutter includes a central portion without teeth.

* * * * *